US007712987B2

(12) United States Patent
Ito et al.

(10) Patent No.: US 7,712,987 B2
(45) Date of Patent: May 11, 2010

(54) SHEET HOLDING STRUCTURE AND PRINTER FOR AN ELECTRONIC VOTING APPARATUS

(75) Inventors: Akihiko Ito, Chiba (JP); Takumi Seino, Chiba (JP)

(73) Assignee: Seiko Instruments Inc. (JP)

( * ) Notice: Subject to any disclaimer, the term of this patent is extended or adjusted under 35 U.S.C. 154(b) by 499 days.

(21) Appl. No.: 11/705,671

(22) Filed: Feb. 13, 2007

(65) Prior Publication Data

US 2008/0279607 A1 Nov. 13, 2008

(30) Foreign Application Priority Data

Apr. 7, 2006 (JP) ..... 2006-105922
Sep. 14, 2006 (JP) ..... 2006-249425

(51) Int. Cl.
*B41J 11/58* (2006.01)

(52) U.S. Cl. ..... 400/613.2; 400/621; 493/320; 493/410

(58) Field of Classification Search ..... 400/613.2, 400/621
See application file for complete search history.

(56) References Cited

U.S. PATENT DOCUMENTS 1,433,183 A * 10/1922 Cossitt ..... 400/613.2
3,232,407 A * 2/1966 Drescher ..... 400/613.2
4,127,858 A * 11/1978 Schiller ..... 400/613.2
4,488,829 A * 12/1984 Hidaka ..... 400/613.2
4,827,841 A * 5/1989 White, Sr. ..... 400/605
4,894,668 A * 1/1990 Ozawa et al. ..... 400/613.2
4,909,648 A * 3/1990 Hartman et al. ..... 400/234
4,992,805 A * 2/1991 Yoshizawa et al. ..... 400/605
5,490,735 A * 2/1996 Brandenburg et al. .... 400/613.1
2001/0000172 A1 4/2001 Barrus et al.

FOREIGN PATENT DOCUMENTS

WO WO-03/071491 8/2003

* cited by examiner

*Primary Examiner*—Jill E Culler
(74) *Attorney, Agent, or Firm*—Adams & Wilks

(57) ABSTRACT

A sheet holding structure comprises a container for holding fanfold paper layered by being alternately folded every predetermined length as a sheet. The container has upper and lower sections that are fixed to each other so as to be non-movable relative one another and that collectively form an accommodation portion that accommodates the fanfold paper. The lower section of the container has an inner wall surface formed in a concave shape along a lengthwise direction of the fanfold paper so that the fanfold paper curves in an inward direction and exerts an expanding force acting, at least in part, against the self-weight of the fanfold paper and in a direction opposite to the inward direction.

22 Claims, 9 Drawing Sheets

SHEET HOLDING STRUCTURE AND PRINTER FOR AN ELECTRONIC VOTING APPARATUS

BACKGROUND OF THE INVENTION

1. Field of the Invention

The present invention relates to a sheet holding structure and a printer for an electronic voting apparatus including the sheet holding structure.

2. Description of the Related Art

Conventional election in a self-governing body or the like has been conducted in such a manner that voters write person names or the like on voting slips and put the slips into a ballot box. Vote counting has been carried out in such a manner that in the presence of election administrators, the ballot box is opened and the voting slips are taken out from the box and are visually read and counted one by one. The conventional election has been entirely conducted through manual work in the manner described above, which elongates a time for counting and confirming a result of the vote counting and increases an effort expended by workers.

Therefore, in recent years, the use of electronic voting computers is being adopted. A fundamental construction of an electronic voting system includes electronic voting terminals respectively arranged in voting booths and a server to which the respective electronic voting terminals are connected. Each electronic voting terminal includes a display apparatus (display) for displaying the names or the like of candidates, and an input apparatus, with which voters cast their votes. There is also a case where a touch panel obtained by integrating the display apparatus and the input apparatus is used.

In the case of the electronic voting, vote counting is performed by compiling at the server electronic data (vote contents) inputted from the input apparatus of each electronic voting terminal. Here, it is desired to carry out inspection in order to confirm whether any fraud or tampering, such as rewriting of the electronic data, has been done to the votes or not. In order to conduct such inspection, it is required that the contents of each vote are not only stored as electronic data but also are printed by a printer to thereby enable storage in the form of a paper medium. That is, it is required to provide a printer connected to the electronic voting terminal.

Patent Documents 1 and 2 disclose an electronic voting apparatus in which a printer is connected to an electronic voting terminal, thereby making it possible to visually confirm a result of printing by the printer in a voting booth. With this construction, the contents of a vote inputted by a voter using an input apparatus are not only transmitted to a server as electronic data but also are printed on paper by the printer, thereby allowing the voter to confirm the vote contents by seeing a result of the printing on the paper through a window portion.

[Patent Document 1] JP 2002-230610 A

[Patent Document 2] JP 2002-279126 A

It is expected that many and unspecified voters votes one after another at the electronic voting apparatus, so it is desired to avoid a situation, in which the printer connected to the electronic voting terminal is out of paper, as much as possible. Accordingly, Patent Documents 1 and 2 adopt a construction in which the printing is performed on a long roll paper and printed portions of the paper are sequentially taken up in a roll manner after the contents of the printing (vote contents) have been confirmed by the voters. When such a take-up system is used, however, results of the voting by the respective voters are printed in the order of the voting, so it is possible to know the contents of the voting by seeing the taken-up roll paper based on the order of the voters, which raises a problem from a privacy standpoint. Also, it is required to prevent a portion, in which the contents of voting by a previous voter has been printed, from being seen by the next voter, which leads to a necessity to convey the printed portion to the outside of the window portion.

With a conceivable measure against this problem, the roll paper is cut off in succession after the printing. In this case, recording sheets generated through the cutoff may be collected, with the collected many recording sheets being scattered to some extent and being taken out relatively at random. Accordingly, the problem in terms of privacy is solved. Also, the portion, in which the contents of the voting of the previous voter have been printed, is cut off from the roll paper and is collected, which prevents a case where the contents of the voting by the previous voter are seen by the next voter.

In the case of adopting a construction in which the roll paper is used and cutting of the roll paper is performed after printing in the manner described above, however, many conveyance rollers that convey the roll paper are required. In the case of adopting a construction in which it is possible for voters to see results of printing through a window portion in the manner described above, it is preferable that the window portion be provided between a print portion of a printer and a roll paper discharge portion, and the size of the window portion be increased in order to make it easy to see the results of the printing. The roll paper is held in a roll manner, so the roll paper has a tendency to be curled. In addition, a leading end of the roll paper is set as a free end. Therefore, it is difficult to convey the roll paper smoothly over a long distance of the window portion described above, which makes it necessary to provide multiple conveyance rollers in the window portion. As a result, a constructive complication, a size increase, and a cost increase of an electronic voting apparatus including a printer become inevitable.

SUMMARY OF THE INVENTION

Accordingly, an object of the present invention is to provide a sheet holding structure and a printer for an electronic voting apparatus including the sheet holding structure, which makes it possible to convey a recording sheet whose leading end is set as a free end smoothly even when only a relatively small number of conveyance rollers are used, thereby allowing a size reduction and a constructive simplification.

A sheet holding structure according to the present invention is characterized in that the sheet holding structure includes:

a container for holding fanfold paper layered by being alternately folded every predetermined length as a recording sheet supplied to a casing of a printer, the container being fitted to the casing, and in that a bottom surface of an accommodation portion of the container is formed in a concave shape along a lengthwise direction of the fanfold paper.

With the sheet holding structure, the self weight of the fanfold paper is mainly exerted not on its bent end portion or thin side end surface but on its printable large-area flat surface (main surface), so the paper is supported without buckling or toppling overdue to the self weight in the container. As a result, an increase of a conveyance load due to the self weight is prevented and smooth sheet feed from the start to the end of the fanfold paper becomes possible. In addition, with the sheet holding structure, the fanfold paper in the layered state is arranged on the bottom surface having the concave shape, thereby obtaining a state where an upper layer portion of the layered fanfold paper is curved more inwardly than a lower layer portion of the fanfold paper. Accordingly, even when the posture of the container is varied, the self weight is not exerted on the upper layer portion of the fanfold paper drawn out at the time of sheet feed, which facilitates smooth drawing out to the outside of the container. Also, the fanfold paper curved inwardly tends to return from the curved state and exerts an outwardly expanding force and a part of the force acts against the self weight. Therefore, the conveyance load due to the self weight of the fanfold paper is alleviated and relatively smooth sheet feed from the start to the end of the fanfold paper becomes possible. Further, it becomes possible to suppress a space occupied by the container in the lengthwise direction of the fanfold paper and therefore miniaturization of the printer is not so hindered.

The container may be fixed to the casing. Alternatively, the container may be detachably attachable to the casing. Still alternatively, the container may be attached to a slide member capable of being set close to the casing and set away from the casing.

According to the present invention, a printer for an electronic voting apparatus includes:

the sheet holding structure described above;

a print portion arranged in the casing, for performing printing on a part of the fanfold paper supplied from the container;

a cutter portion arranged in the casing, for cutting off a printed portion, in which the printing has been performed by the print portions of the fanfold paper;

a window portion provided to the casing on a downstream side of the print portion in a travel direction of the fanfold paper, for allowing visual confirmation of the printed portion from the outside; and a discharge opening provided to the casing on a downstream side of the window portion in the travel direction of the fanfold paper, for discharging the printed portion cut off by the cutter portion.

The printer uses the fanfold paper, which does not have a tendency to be curled unlike a roll paper, as a recording sheet, so even when a leading end is set as a free end, it becomes possible to travel the paper smoothly over a long distance. Accordingly, even when the window portion is formed in a relatively large size in order to facilitate visual confirmation, no recording sheet conveyance mechanism (conveyance rollers or the like) needs to be provided in the window portion, so a size reduction, a thickness reduction, and a constructive simplification of the printer become possible.

When the container is fitted to the casing, it becomes possible to deal with the container and the casing of the printer as one unit, which facilitates attachment and detachment with respect to other members of the printer and maintenance work.

According to the present invention, fanfold paper is used as a recording sheet, so there is no tendency to be curled unlike the case of a roll paper. Accordingly, even when the recording sheet has a leading end that is set as a free end, smooth traveling over along distance becomes possible. As a result, it becomes unnecessary to provide a conveyance mechanism, such as rollers, for supporting and conveying the recording sheet in a window portion for enabling visual confirmation of print results from the outside, which enables a size reduction, a thickness reduction, and a constructive simplification of a printer.

Also, according to the present invention, it becomes possible to suppress an increase of the conveyance load due to the self weight of the fanfold paper. In particular, in the upper layer portion of the fanfold paper drawn out to the outside of the container, the conveyance load due to the self weight is alleviated, so it is possible to relatively smoothly draw out and feed sheet from the start to the end of the fanfold paper. Further, it is possible to suppress a space occupied by the container in the lengthwise direction of the fanfold paper.

BRIEF DESCRIPTION OF THE DRAWINGS

In the accompanying drawings:

FIG. 7A' is a schematic diagram viewed from a side of FIG. 7A; FIG. 7B' is a schematic diagram viewed from a side of FIG. 7B.

FIG. 8A' is a schematic diagram viewed from above FIG. 8A; FIG. 8B' is a schematic diagram viewed from above FIG. 8B.

DETAILED DESCRIPTION OF THE PREFERRED EMBODIMENT

Embodiments of the present invention will be described below with reference to the drawings.

Figure 1:
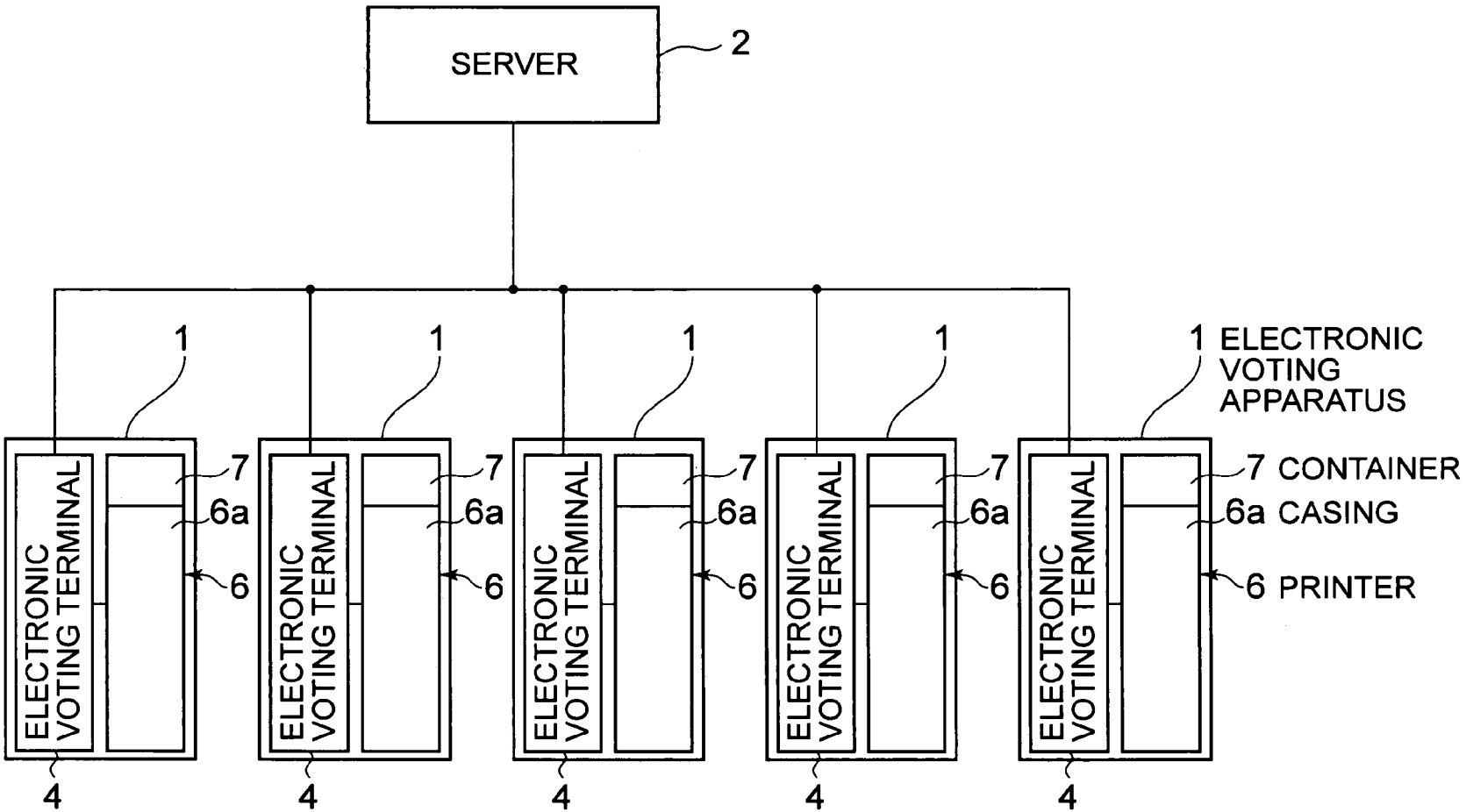
FIG. 1 is a block diagram showing an example of an electronic voting system including an electronic voting apparatus according to the present invention.

FIG. 1 schematically shows an example of an overall construction of an electronic voting system including electronic voting apparatuses 1 according to an embodiment of the present invention. The electronic voting system has a construction in which many electronic voting apparatuses 1 are connected to a server 2 (in FIG. 1, only five electronic voting apparatuses 1 are illustrated).

Figure 2:
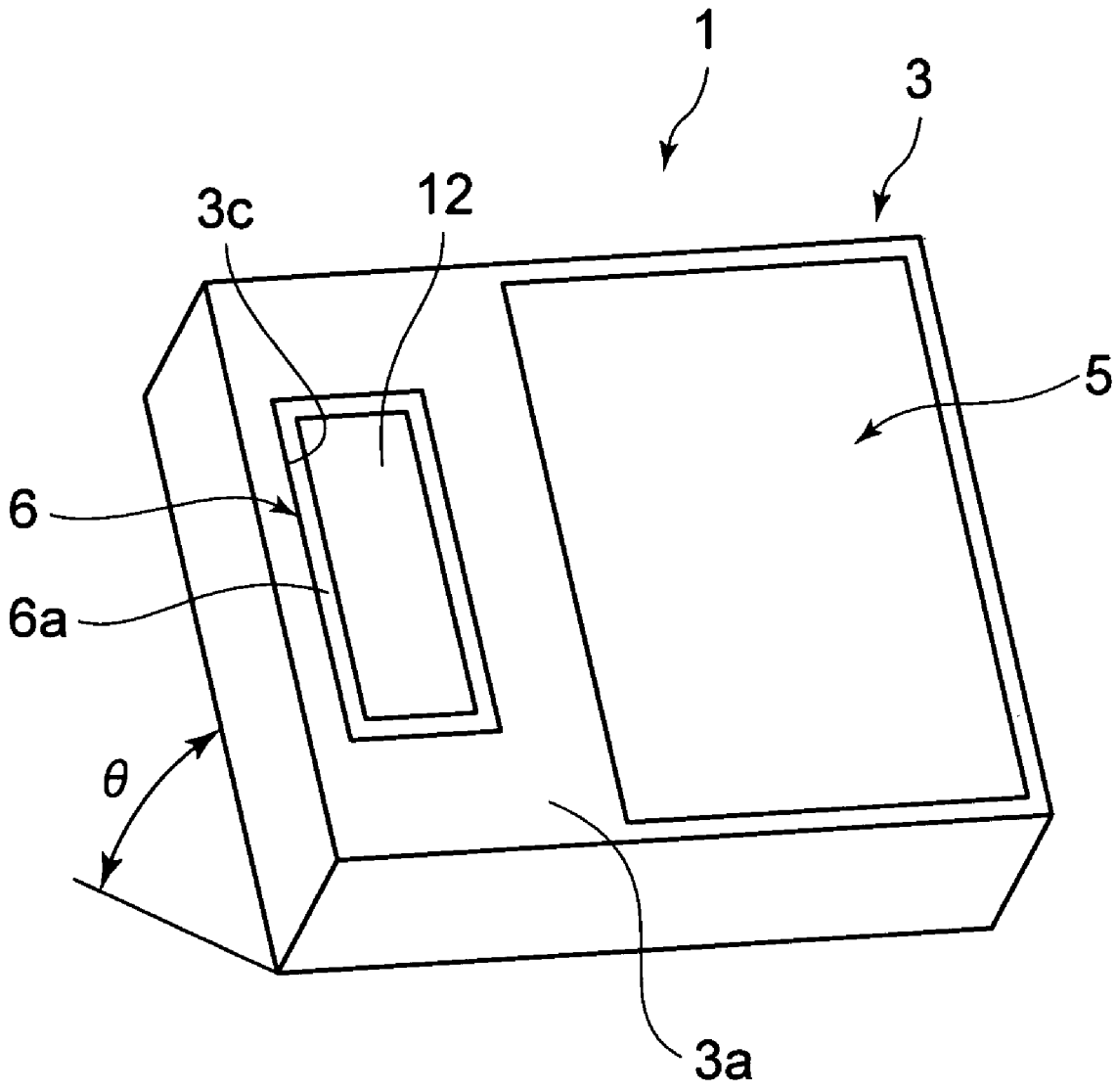
FIG. 2 is a perspective view showing an example of a main portion of the electronic voting apparatus shown in FIG. 1.

As shown in FIG. 2, for instance, each electronic voting apparatus 1 constitutes a voting booth 3 including a base surface 3*a* and is provided with a touch panel 5 doubling as a display apparatus and an input apparatus of an electronic voting terminal 4 (see FIG. 1). For instance, the touch panel 5 has a construction in which the multiple choices (multiple candidate names, for instance) are displayed on a display portion (display apparatus) and a voter inputs vote contents by touching an input switch (input apparatus) at a position corresponding to a choice (candidate name, for instance) selected from among the choices displayed on the display portion. Note that it is preferable that a shield member be provided around the voting booth 3 in order to prevent the vote contents inputted through the touch panel 5 from being seen by other persons. Also, a printer 6 for the electronic voting apparatus is attached on a side of the touch panel 5. A casing 6*a* of the printer 6 is provided with a window portion 12 at a position at which the inside of the casing is exposed through a hole portion 3*c* of the base surface 3*a*. The detailed construction of the printer 6 will be described later but the printer 6 is provided with a container 7, for holding fanfold paper 16 (schematically shown in FIG. 4) layered by being alternately folded every predetermined length as a recording sheet, and a print portion and a cutter portion 11 provided in the casing 6*a*.

The electronic voting apparatus 1 has a pivoting mechanism (not shown), with which adjustment of an angle θ of the whole of the voting booth 3 including the printer 6 shown in FIG. 2 is made possible. This construction makes it possible to freely move the touch panel 5 to a certain posture and keep it, thereby making it easy as much as possible for voters to operate the touch panel 5 even when they have disabilities or they are very tall or short.

Next, the printer 6 of the electronic voting apparatus 1 according to this embodiment will be described in detail with reference to FIGS. 3 and 4. The printer 6 includes the casing 6*a* attached to the base surface 3*a* of the voting booth 3, with the window portion 12 being provided for a surface exposed to the voting booth 3 of the casing 6*a*. The container 7 is attached to a surface of the casing 6*a* on a side opposite to the window portion 12.

Figure 4:
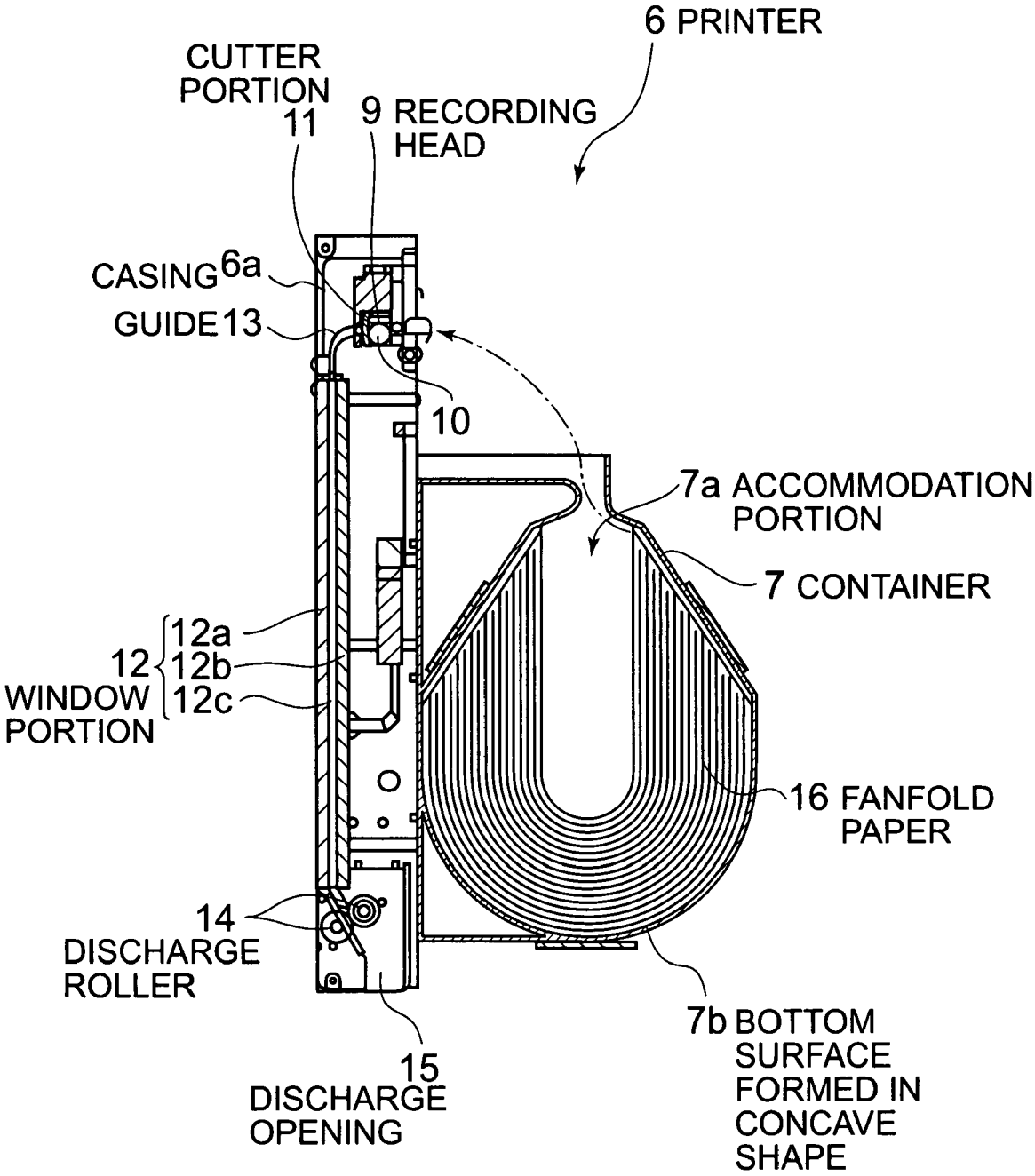
FIG. 4 is a cross-sectional view taken along the line A-A of FIG. 3A.

FIG. 4 shows an internal construction of the casing 6*a* of the printer 6. In the casing 6*a*, a recording head (such as a thermal head) 9 for performing printing on the fanfold paper 16 is provided. The recording head 9 is arranged so as to be disposed at an upper position when the printer 6 is attached to the voting booth 3. In addition, a platen roller 10 is arranged to oppose the recording head 9. The platen roller 10 is provided to convey the fanfold paper 16 while the recording head 9 presses the fanfold paper 16 against the platen roller 10. In this specification, a portion, in which the recording head 9 and the platen roller 10 are provided, is referred to as the "print portion".

On a downstream side with respect to the print portion in a conveyance direction of the fanfold paper 16, a cutter portion 11 that is capable of cutting the fanfold paper 16 is provided. Any known construction can be adopted for the cutter portion 11, so no detailed description is given here. For instance, a construction may be used in which a fixed blade and a movable blade are arranged to oppose each other and the fanfold paper 16 is cut by moving the movable blade toward the fixed blade.

On the downstream side with respect to the print portion in the conveyance direction of the fanfold paper 16, a guide 13 for guiding the fanfold paper 16 having passed through the print portion and the cutter portion 11 is provided. The fanfold paper 16 guided by the guide 13 is led to the window portion 12. The window portion 12 has a construction in which a transparent plate 12*a*, which is made of a synthetic resin (such as polycarbonate, ABS resin, or acrylic) and is arranged on a surface exposed to the voting booth 3, and an opposing plate 12*b*, which is not limited to a transparent plate, oppose each other with a slight gap 12*c* in-between. Accordingly, it becomes possible for voters to, when the fanfold paper 16 led by the guide 13 passes through the gap 12*c* between the transparent plate 12*a* and the opposing plate 12*b*, see portions, in which printing has been performed by the recording head 9, of the fanfold paper 16 from the outside of the casing 6*a*, that is, from the inside of the voting booth 3 in a case where the printer 6 is attached to the base surface 3*a*. Note that in a region of the window portion 12, no conveyance mechanism, such as rollers, for conveying the fanfold paper 16 is provided. In addition, on a downstream side with respect to the window portion 12 in the conveyance direction of the fanfold paper 16, a discharge roller 14 and a discharge opening 15 for discharging the fanfold paper 16 are provided.

The container 7 includes an accommodation portion 7*a* that is capable of accommodating the fanfold paper 16 and is attached to a surface on a side opposite to the window portion 12 of the casing 6*a* of the printer 6. In this embodiment, a bottom surface 7*b* of the accommodation portion 7*a* is formed in a concave shape (approximately U shape, for instance) with respect to the lengthwise direction of the fanfold paper 16 accommodated in the accommodation portion 7*a*. Accordingly, the fanfold paper 16 is placed on the bottom surface 7*b* in the approximately U shape in a curved state. Note that the bottom surface 7*b* of the container 7 in this specification refers to a surface positioned oh a side opposite to an uppermost layer portion of the fanfold paper 16 drawn out at the time of sheet feed, that is, a surface (see FIGS. 3 and 4) that is abutted against and supports a lowermost large-area flat surface (main surface) of the fanfold paper 16 in the layered state regardless of the posture of the printer 6 at the time of use. In other words, the bottom surface 7*b* is ordinarily an inner surface of the container 7 that mainly receives the self weight of the fanfold paper 16 in a state where the fanfold paper 16 is held in the container 7.

Figure 5:
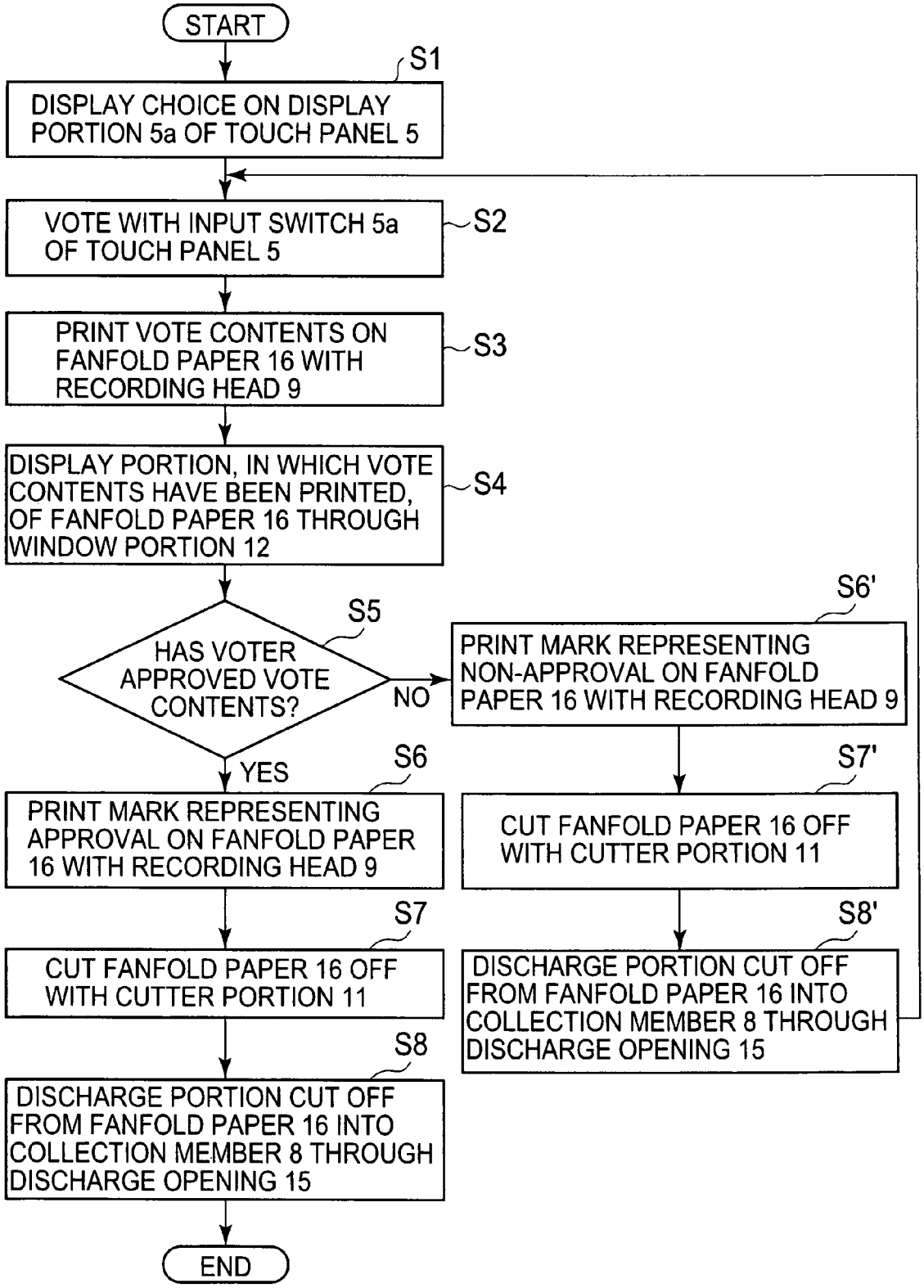
FIG. 5 is a flowchart showing an example of an electronic voting method implemented by the electronic voting system shown in FIG. 1.

An example of a method of casting a vote using the electronic voting apparatus 1 having the construction described above will be described with reference to a flowchart shown in FIG. 5. On the touch panel 5 of the electronic voting apparatus 1 shown in FIG. 2, multiple choices, such as multiple candidate names, which are the targets of voting are displayed (Step S1). In this state, a voter selects one of the choices displayed on the display portion of the touch panel 5 and touches an input switch corresponding to the selected choice (Step S2). In response to this operation, the electronic voting terminal 4 transmits to the printer 6 inputted contents, that is, data indicating the selected choice.

A leading end of the fanfold paper 16 accommodated in the accommodation portion 7*a* of the container 7 is drawn out and is set in the print portion of the printer 6 in advance (see the two-dot chain arrow of FIG. 4). In this state, when the data indicating the selected choice has been transmitted from the electronic voting terminal 4 as data to be printed in the manner described above, the recording head 9 of the printer 6 prints the contents of the selected choice (selected candidate name, for instance) on a surface on one side of the fanfold paper 16 (Step S3). Then, the platen roller 10 conveys the fanfold paper 16 and leads the paper 16 to the window portion 12 while guiding it with the guide 13. Following this, when a portion, in which the printing has been performed by the recording head 9, of the fanfold paper 16 reaches the gap 12*c* of the window portion 12, the conveyance of the fanfold paper 16 by the platen roller 10 is temporarily halted. In this state, the printed contents (selected candidate name, for instance) are exhibited so that they can be seen by the voter in the voting booth 3 through the transparent plate 12*a* and the hole portion 3*c* (Step S4).

The voter in the voting booth 3 visually confirms the printed contents (selected candidate name, for instance) through the window portion 12 and the hole portion 3*c* and, in the case of approval, operates the input portion of the touch panel 5 as appropriate in order to express his/her intention to determine the vote contents (Step S5). When detecting this input, the electronic voting terminal 4 transmits a print command, which expresses that the vote contents have been determined, to the printer 6. Then, the recording head 9 of the printer 6 prints a letter or a symbol such as "o" or "OK", which indicates that the vote contents have been determined, and a symbol such as barcode, which expresses the vote contents, in the rear of the printed portion of the fanfold paper 16 (Step S6) Then, the cutter portion 11 cuts the fanfold paper 16 (Step S7) When doing so, the portion, in which the selected contents such as selected candidate name have been printed, and a portion, in which the letter or symbol indicating that the vote contents have been determined and the barcode have been printed, are converted into a cut-sheet shape through cutting off from the fanfold paper 16, are conveyed by the discharge roller 14, and are discharged through the discharge opening 15 (Step S8).

On the other hand, when the voter finds a mistake in the input operation or wants to change the vote contents, for instance, in Step S5, he/she operates the input portion of the touch panel 5 as appropriate in order to express his/her desire to change the input instead of approving the printed contents. When detecting this non-approval operation (desire for a change), the electronic voting terminal 4 transmits a print command, which expresses that the vote contents have been non-approved, to the printer 6. Then, the recording head 9 of the printer 6 prints a letter or a symbol such as "x" or "NG", which indicates that the vote contents have been non-approved, in the rear of the printed portion of the fanfold paper 16 (Step S6'). Then, the cutter portion 11 cuts the fanfold paper 16 (Step S7'). When doing so, a portion, in which the non-approved contents and the letter or symbol indicating that the vote contents have been non-approved have been printed, is converted into a cut-sheet shape through cutting off from the fanfold paper 16, is conveyed by the discharge roller 14, and is discharged through the discharge opening 15 (Step S8'). Following this, the voting by the voter (Step S2), the printing by the printer 6 (Step S3), and the indication of the contents of printing (Step S4) are performed again. After that, when the voter approves the vote contents in Step S5, the recording head 9 of the printer 6 prints a letter or a symbol such as "o" or "OK", which indicates that the vote contents have been determined, and a symbol such as barcode, which expresses the vote contents, in the rear of the printed portion of the fanfold paper 16 (Step S6). Then, the fanfold paper 16 is cut off by the cutter portion 11 (Step S7) into a cut-sheet shape and is discharged through the discharge opening 15 (Step S8).

Upon completion of the voting by one voter through the processing of Steps S1 to S8 described above, the electronic voting apparatus 1 enters into a standby state of preparing for voting by the next voter. At this time, the leading end of the fanfold paper 16 is positioned at the cutter portion 11 and does not exist in the window portion 12. The portion, in which the contents of the voting by the previous voter have been printed, has been cut off by the cutter portion 11 and discharged as described above, so the vote contents are never seen by the next voter. Then, the voting operations (steps S1 to S8) described above are performed by the next voter.

When such voting operations are repeated at the many electronic voting apparatuses 1 and the contents of votes are transmitted from the electronic voting apparatuses 1 to the server as electronic data at an arbitrary timing, the contents of many votes are accumulated at the server 2 as electronic data, and at the same time, many recording sheets in a cut-sheet shape, on which the vote contents have been printed, are accommodated in each electronic voting apparatus 1. When a vote is cast by every eligible voter or when a predetermined time period for voting expires, reception of votes is ended. Then, the server 2 counts the vote contents transmitted from each electronic voting apparatus 1. In addition, like in a conventional case, it is also possible for workers to count the vote contents by manually taking out and reading the accommodated recording sheets in a cut-sheet shape one by one. It is possible to use a result of the latter counting work for verification as a backup for the electronic counting by the server 2. The manual counting work may be performed for every electronic voting apparatus 1 as necessary. Alternatively, the manual counting work may be performed only for some of the electronic voting apparatuses 1. Still alternatively, the manual counting work may be performed only when any problem arises at the time of the vote counting by the server 2.

In this embodiment, on the occasion of the electronic voting, after input by operating the input portion of the touch panel 5, the voter can visually confirm the fanfold paper 16, on which his/her vote contents have been printed, through the window portion 12. Then, the vote contents that the voter has finally approved are sent to the server 2 at an arbitrary timing. Accordingly, it becomes possible to prevent the voter from making an operation mistake or the like and erroneously casting a vote and it also becomes possible to cope with a situation in which the voter wants to change his/her vote contents. In the manner described above, it is possible for the voter to cast a desired vote.

Also, as described above, as a backup for electronic vote data, recording sheets, on which the contents of votes have been printed, are created. The contents of votes before changing which are not yet finally approved by voters are given a letter or a symbol such as "x" or "NG", which indicates a negative meaning, so it becomes possible to neglect such vote contents at the time of counting by manual work. On the other hand, the correct contents of votes, which have been finally approved by voters, are given a letter or a symbol such as "o" or "OK", which indicates a positive meaning, and a symbol such as a barcode, which indicates the vote contents, so it becomes possible to conduct counting by manual work or automatic work with precision. That is, on each recording sheet that has been cut off and converted into a cut-sheet shape, not only the contents of a vote but also a letter or a symbol, which expresses whether the vote contents have been approved or not, are printed. As a result, it is necessary to confirm the letter or symbol at the time of vote counting. Through the confirmation, it becomes possible to prevent a mistake in counting even when the vote contents have been changed.

In this construction, when a sufficiently large window portion 12 is provided and inputted contents are largely printed and displayed to the full range of the window portion 12, it becomes possible to display the contents so as to be generally seen by the voters in a wide variety of elections. However, when a roll paper is used as the recording sheet like in a conventional case, the roll paper has a tendency to be curled, so it is difficult to travel the roll paper, whose leading end is set as a free end, smoothly over a long distance. Consequently, in order to convey the roller paper while supporting it, multiple conveyance rollers need to be arranged in the window portion 12. As a result, the thickness of the window portion 12 is increased and the size of the printer 6 is increased. Also, due to a mechanism for supplying a driving force to the conveyance rollers provided in the window portion 12, a constructive complication becomes inevitable. Further, in order to prevent the conveyance rollers provided in the window portion 12 from obstructing visual confirmation of a portion of the recording sheet in which printing has been performed, it is desired to arrange the conveyance rollers in areas other than the center of the window portion 12, so it becomes necessary to further increase the size of the casing 6*a* accordingly.

In contrast to this, in this embodiment, the fanfold paper 16 is used as the recording sheet. The fanfold paper 16 is a type of paper layered by being alternately folded every predetermined length, so there is no tendency to be curled in the leading end portion of the paper in which paper jamming easily occurs. Accordingly, even when the leading end of the fanfold paper 16 is a free end, it is easy for the fanfold paper 16 to travel through the gap 12*c* of the window portion 12 smoothly, which eliminates the necessity to provide the conveyance rollers in the window portion 12. As a result, it becomes possible to prevent a size increase and a constructive complication of the printer 6.

Also, in this embodiment, the container 7 accommodating the fanfold paper 16 is directly attached to the casing 6*a* of the printer 6. That is, it is possible to integrally deal with the casing 6*a* and the container 7, in other words, handling as one unit, in which the printer 6 includes the recording sheet container 7, is possible, so attachment and detachment with respect to the base surface 3*a* become easy. Accordingly, it becomes possible to attach a single printer 6 to various voting booths. In addition, maintenance work is facilitated.

When the self weight of the fanfold paper 16 is mainly exerted on a bent end portion or an extremely thin side end surface, it becomes impossible to support the self weight and the fanfold paper 16 buckles or topples over in the accommodation portion 7*a*, which increases a conveyance load. As a result, even when the leading end side of the fanfold paper 16 is pulled by the platen roller 10, the fanfold paper 16 is not successively sent out from the inside of the accommodation portion 7*a* smoothly, which leads to a fear that a sheet feed failure will occur. In contrast to this, when the fanfold paper 16 is arranged approximately horizontally so that the printable large-area flat surface (main surface) of the fanfold paper 16 is arranged approximately vertically to the direction of gravity, it becomes possible to support the self weight of the fanfold paper 16 by the large-area flat surface (main surface), which enables smooth conveyance. In this case, however, a space, which is wide in the lengthwise direction of the fanfold paper 16, is required outside the casing 6*a*, so miniaturization of the printer 6 is hindered. Also, when the electronic voting apparatus 1 including the base surface 3*a* and the container 7 tilts within an angle adjustment range as shown in FIG. 2, there is a fear that the self weight of the fanfold paper 16 is exerted not only on the large-area flat surface (main surface) but also on the bent end portion or the side end surface, and therefore buckling or toppling over occurs and the conveyance load increases.

In view of this problem, in this embodiment, the bottom surface 7*b* of the accommodation portion 7*a* of the container 7 is formed in a concave shape (approximately U shape) along the lengthwise direction of the fanfold paper 16 accommodated in the accommodation portion 7*a*. With this construction, it becomes possible to suppress an increase of the conveyance load due to the self weight of the fanfold paper 16 in the accommodation portion 7*a* of the container 7. That is, with the sheet holding structure according to this embodiment, the fanfold paper 16 is held on the bottom surface 7*b* having the concave shape (approximately U shape). In this state, the self weight of the fanfold paper 16 is mainly exerted not on the bent end portion or the thin side end surface but on the printable large-area flat surface (main surface), so the fanfold paper 16 is supported without buckling or toppling over due to the self weight in the container 7. As a result, the conveyance load does not increase due to the self weight.

In the construction according to this embodiment, the fanfold paper 16 is held in a state where it is curved in a shape prescribed in advance along the bottom surface 7*b* having the concave shape (approximately U shape). As shown in FIG. 2, the electronic voting apparatus 1 including the base surface 3*a* and the container 7 tilts within the predetermined angle adjustment range. Even when the container 7 tilts as a result of angle adjustment, the fanfold paper 16 is not curved in an unexpected shape or an irregular shape and does not buckle or topple over due to the self weight. That is, the fanfold paper 16 is always held in a state where it is precisely and regularly curved in the shape prescribed by the bottom surface 7*b* having the concave shape (approximately U shape). Accordingly, no unexpected excess conveyance load of the fanfold paper 16 occurs, which makes it possible to suppress the conveyance load into a range calculated in advance at the time of design. In addition, with this construction, the layered fanfold paper 16 placed on the bottom surface 7*b* is placed in a state where its upper layer portion is curved more inwardly than its lower layer portion. Consequently, even when the posture of the container 7 varies to some extent, the self weight is not exerted on the upper layer portion of the fanfold paper 16 drawn out at the time of sheet feed, which facilitates smooth drawing out of the fanfold paper 16 to the outside of the container 7. Also, the fanfold paper 16 curved inwardly tries to return from the curved state and exerts an outwardly expanding force, with a part of the force acting against the self weight. As a result, the conveyance load due to the self weight of the fanfold paper 16 is alleviated and relatively smooth sheet feed from the start to the end of the fanfold paper 16 becomes possible. Further, it becomes possible to suppress a space occupied by the container in the lengthwise direction of the fanfold paper 16 and therefore miniaturization of the printer is not so hindered.

As described above, in this embodiment, smooth conveyance of the recording sheet is made possible by using the fanfold paper 16 and forming the bottom surface 7*b* of the container 7 accommodating the fanfold paper 16 in the concave shape.

It should be noted here that in the construction shown in FIG. 4, the recording head 9 and the cutter portion 11 are set extremely close to each other. Therefore, even when the fanfold paper 16 is not rewound after being cut, it becomes possible to perform the next printing from the vicinity of the leading end of the remaining fanfold paper 16 and therefore wasteful margins are hardly generated. Each portion, in which the contents of a vote cast by a voter have been printed, is cut off by the cutter portion 11 and is discharged through the discharge opening 15, so it becomes impossible to identify the voter corresponding to the portion and the vote contents are prevented from being seen by the next voter.

The concave shape of the bottom surface 7*b* of the accommodation portion 7*a* of the container 7 is not limited to the approximately U shape described above and may be changed to various other shapes, such as a shape obtained by dividing an ellipse into two parts and a shape obtained by dividing a polygon (such as a hexagon or an octagon) into two parts, so long as the shapes are concave.

Next, other embodiments of the present invention schematically shown in FIGS. 6 to 9 will be described.

Figure 3C:
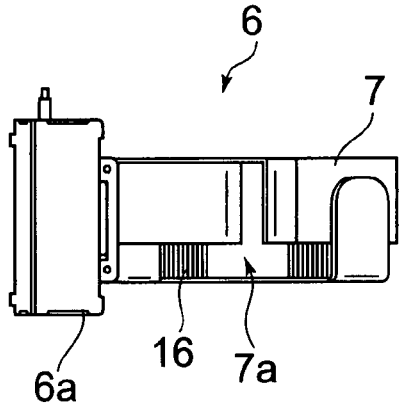
FIG. 3C is a plan view thereof.
Figure 3A:
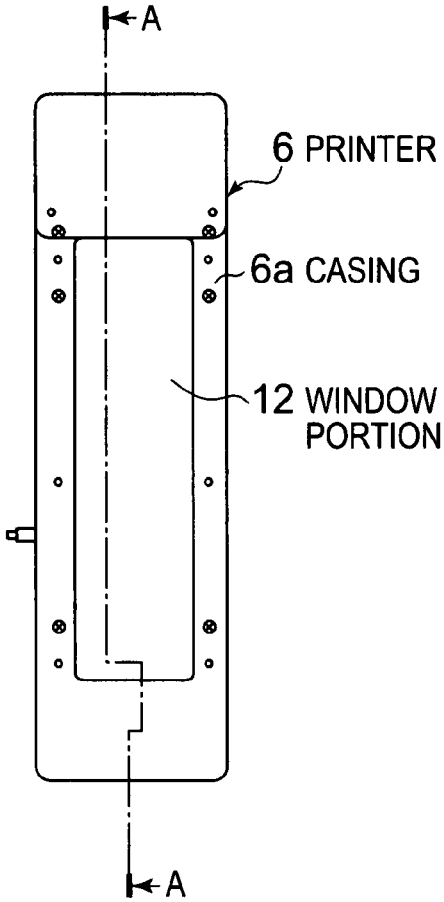
FIG. 3A is a side view showing an example of a main portion of a printer for an electronic voting apparatus according to a first embodiment of the present invention.
Figure 3B:
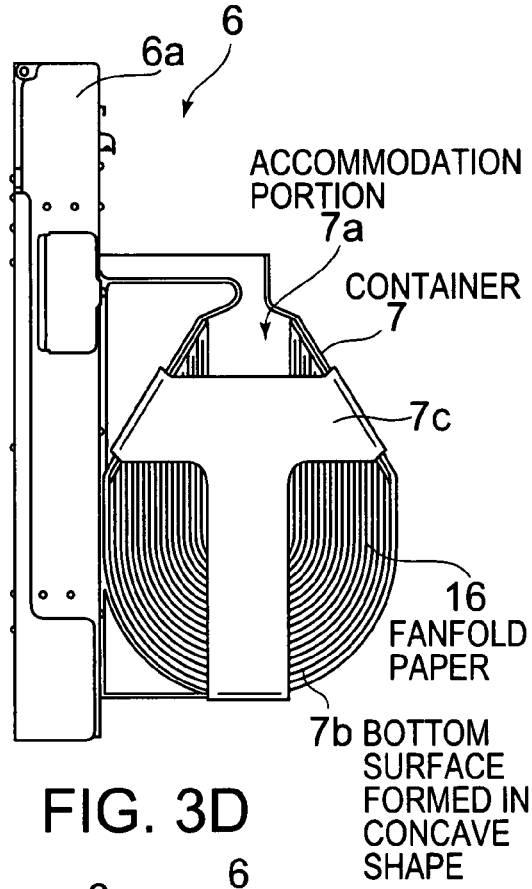
FIG. 3B is a front view thereof.
Figure 3D:
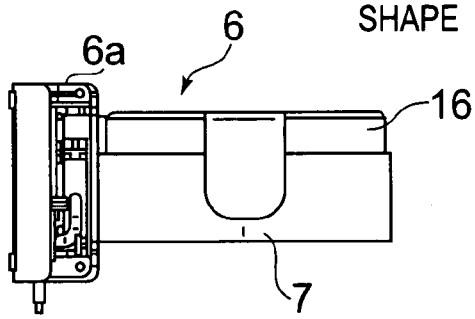
FIG. 3D is a bottom view thereof.

In the first embodiment described above, a construction has been explained in which the fanfold paper 16 deformed in the U shape is inserted into the container 7 from a side (from the front on the paper planes of FIG. 3B and FIG. 4). Note that at the time of the insertion of the fanfold paper 16 into the container 7, the cover 7*c* is detached. Then, after the fanfold paper 16 has been inserted into the container 7, the cover 7*c* is attached to thereby prevent the fanfold paper 16 from falling out of the container 7.

Figure 6A:
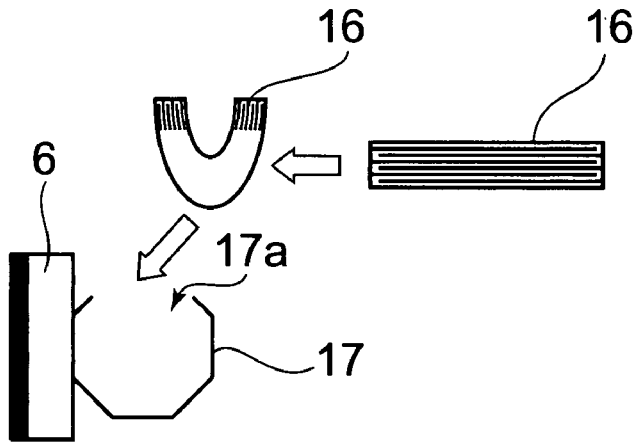
FIG. 6A is a schematic diagram showing a state where fanfold paper is inserted into a container of a printer for an electronic voting apparatus according to a second embodiment of the present invention.
Figure 6B:
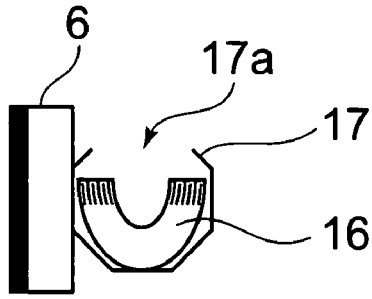
FIG. 6B is a schematic diagram showing a state where the fanfold paper is held in the container.

In contrast to this, a container 17 in a second embodiment schematically shown in FIG. 6 has a construction in which a relatively large opening portion 17*a* is provided in an upper area and the fanfold paper 16 deformed in a U shape is inserted into the container 17 from above (see FIG. 6A). In this embodiment, it is possible to perform both of feed of the fanfold paper 16 to the casing 6 and the insertion of the fanfold paper 16 into the container 17 through the same opening portion 17*a* provided in the upper area of the container 17, so the structure is simplified. Also, with this construction, open/close of a cover becomes unnecessary. Further, as shown in FIG. 6B, it becomes possible to draw out the uppermost portion of the fanfold paper 16 held in the container 17 and insert the drawn-out portion into the casing 6 to be set.

In third embodiment schematically shown in FIG. 7, a container 18 includes a main body portion 18*a* and a cover 18*b* that is attached to the main body portion 18*a* through a hinge mechanism 19. The cover 18*b* can be opened/closed with respect to the main body portion 18*a* through pivotal movement in a vertical direction. Accordingly, in this embodiment, in a state where the cover 18*b* has been pivoted downwardly and opened as shown in FIGS. 7A and 7A', the fanfold paper 16 is inserted into the main body portion 18*a* from a side (from the front in FIG. 7A, from the left in FIG. 7A') and then the container 18 is closed by pivoting the cover 18*b* upwardly as shown in FIGS. 7B and 7B'. Following this, the container 18 is attached to the casing 6 as shown in FIG. 7C and then the uppermost portion of the fanfold paper 16 in the container 18 is drawn out and is inserted into the casing 6. It is possible to set the fanfold paper 16 in this manner. Illustration of an opening of the container 18 that functions as a passage at the time of feed of the fanfold paper 16 is omitted.

Figure 7A:
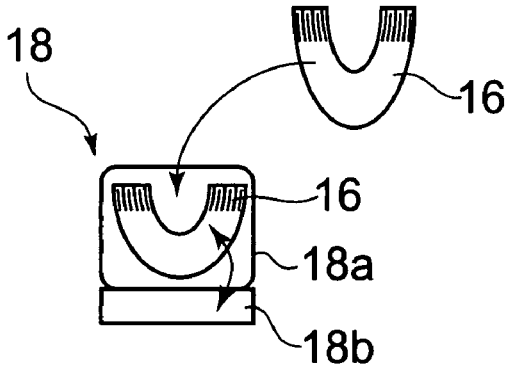
FIG. 7A is a schematic diagram showing a state where a cover of a container of a printer for an electronic voting apparatus according to a third embodiment of the present invention is opened and fanfold paper is inserted.
Figure 7A:
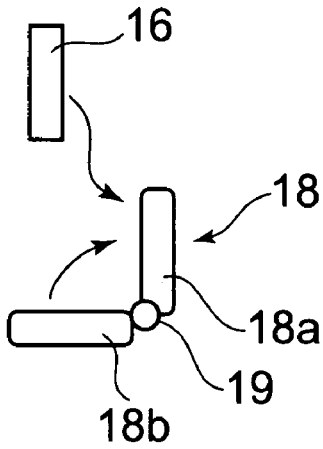
Figure 7B:
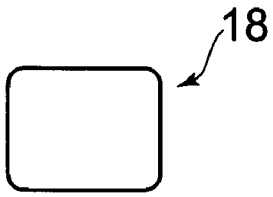
FIG. 7B is a schematic diagram showing a state where the cover of the container is closed.
Figure 7B:
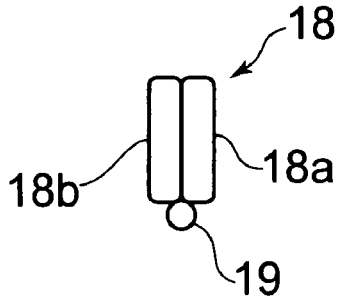
Figure 7C:
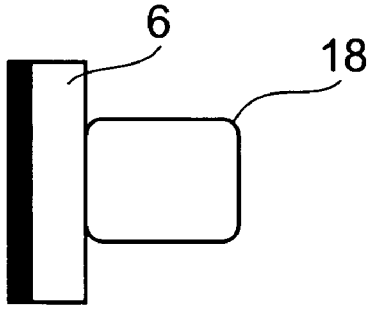
FIG. 7C is a schematic diagram showing a state where the fanfold paper is held in the container and the container is attached to the casing.

It should be noted here that FIG. 7A' is a drawing obtained by viewing FIG. 7A from a side, and FIG. 7B' is a drawing obtained by viewing FIG. 7B from a side. In FIGS. 7A' and 7B', for ease of understanding, the hinge mechanism 19 is illustrated in a size larger than an actual size. However, the actual size is relatively small, so illustration of the hinge mechanism 19 is omitted in FIGS. 7A, 7B, and 7C.

In this embodiment, the container 18 is detachably attachable to the casing 6, so it becomes possible to conduct work for inserting the fanfold paper 16 into the container 18 with ease in a wide space spaced apart from the casing 6.

A fourth embodiment schematically shown in FIG. 8 differs from the second embodiment schematically shown in FIG. 7 in the open/close direction (pivoting direction) of the cover. That is, in this embodiment, a container 21 includes a main body portion 21*a* and a cover 21*b* that is attached to the main body portion 21*a* through a hinge mechanism 22. The cover 21*b* can be opened/closed with respect to the main body portion 21*a* through pivotal movement in a horizontal direction. Accordingly, in this embodiment, in a state where the cover 21*b* is pivoted to be opened as shown in FIGS. 8A and 8A', the fanfold paper 16 is inserted into the main body portion 21*a* from a side (from the front in FIG. 8A, from the lower portion in FIG. 8A') and then the container 21 is closed by pivoting the cover 21*b* as shown in FIGS. 8B and 8B'. Following this, the container 21 is attached to the casing 6 as shown in FIG. 8C and then the uppermost portion of the fanfold paper 16 in the container 21 is drawn out and is inserted into the casing 6. It is possible to set the fanfold paper 16 in this manner. Illustration of an opening of the container 21 that functions as a passage at the time of feed of the fanfold paper 16 is omitted.

Figure 8A:
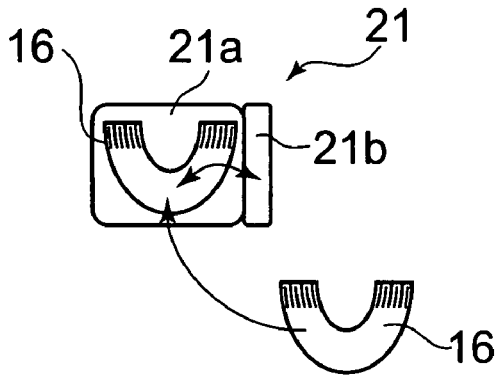
FIG. 8A is a schematic diagram showing a state where a cover of a container of a printer for an electronic voting apparatus according to a fourth embodiment of the present invention is opened and fanfold paper is inserted.
Figure 8A:
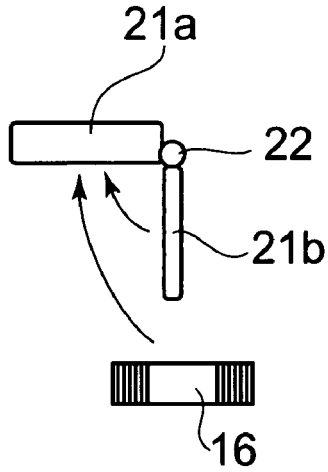
Figure 8B:
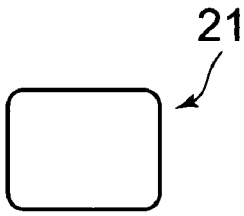
FIG. 8B is a schematic diagram showing a state where the cover of the container is closed.
Figure 8B:
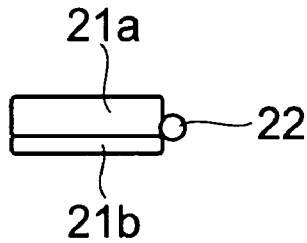
Figure 8C:
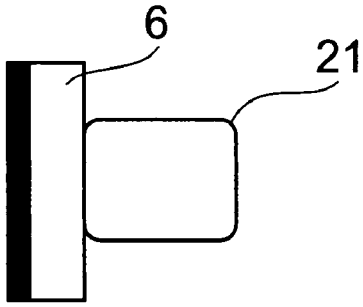
FIG. 8C is a schematic diagram showing a state where the fanfold paper is held in the container and the container is attached to the casing.

It should be noted here that FIG. 8A' is a drawing obtained by viewing FIG. 8A from above, and FIG. 8B' is a drawing obtained by viewing FIG. 8B from above. In FIGS. 8A' and 8B', for ease of understanding, the hinge mechanism 22 is illustrated in a size larger than an actual size. However, the actual size is relatively small, so illustration of the hinge mechanism 22 is omitted in FIGS. 8A, 8B, and 8C.

In this embodiment, the container 21 is detachably attachable to the casing 6, so it becomes possible to conduct work for inserting the fanfold paper 16 into the container 21 with ease in a wide space spaced apart from the casing 6.

It should be noted here that in each of the third and fourth embodiments shown in FIGS. 7 and 8, the hinge mechanism is used but a construction is also possible in which the container is closed by sliding the cover with respect to the main body portion. In this case, a slide direction of the cover with respect to the main body portion may be one of a vertical direction, a horizontal direction, and an inclined direction.

Figure 9A:
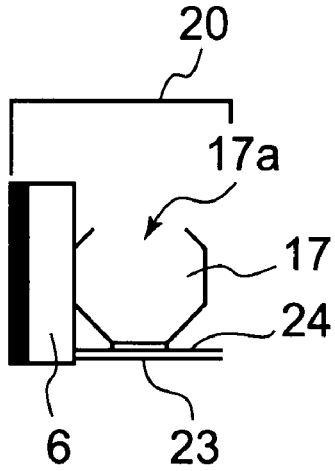
FIG. 9A is a schematic diagram showing an initial state of a container of a printer for an electronic voting apparatus according to a fifth embodiment of the present invention.
Figure 9B:
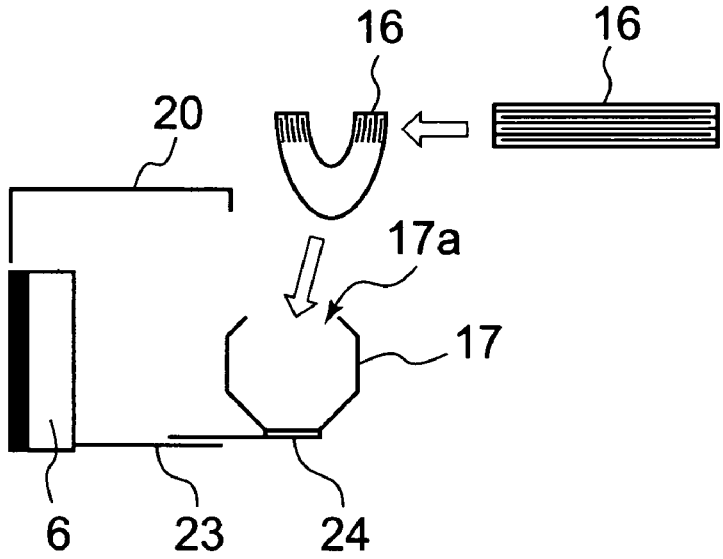
FIG. 9B is a schematic diagram showing a state where the container is pulled out and fanfold paper is inserted.
Figure 9C:
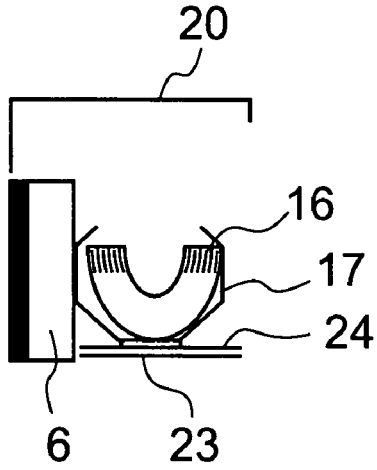
FIG. 9C is a schematic diagram showing a state where the fanfold paper is held in the container.

In a fifth embodiment schematically shown in FIG. 9, a container 17 that is the same as that in the second embodiment is attached to a slide member 24 that is slidable along a guide member 23 provided for the casing 6. Accordingly, the container 17 in an initial state shown in FIG. 9A is drawn out through sliding of the slide member 24 so that the container 17 is spaced apart from the casing 6 as shown in FIG. 9B. Then, the fanfold paper 16 deformed in a U shape is inserted into the container 17 from above. Following this, the container 17 is set close to the casing 6 by sliding the slide member 24 as shown in FIG. 9C. Finally, the uppermost portion of the fanfold paper 16 in the container 17 is drawn out and is inserted into the casing 6. It is possible to set the fanfold paper 16 in this manner.

With this construction, it becomes possible to perform the insertion of the fanfold paper 16 in a space with a relatively wide surrounding space merely by conducting such extremely simple work that the container 17 is pulled out by sliding the slide member 24 along the guide member 23. Accordingly, other members 20 (schematically illustrated in FIGS. 9A to 9C) attached to the printer 6 or the voting booth, a control apparatus (not shown), and the like do not become obstacles and it becomes possible to perform the insertion of the fanfold paper 16 with ease. In addition, such troublesome work becomes unnecessary that the container 17 is attached to the casing 6 through, for instance, hooking on a rear side of the printer existing at a backward position. That is, the construction in this embodiment has both of the same advantages as in the third and fourth embodiments (see FIGS. 7 and 8) and as in the first and second embodiments. The advantage of the third and fourth embodiments is that the container is detachably attachable to the casing, in other words, it becomes possible to conduct work for inserting the fanfold paper 16 into the container in a wide space with ease. The advantage of the first and second embodiments is that the container is fixed to the casing, in other words, there is no necessity to conduct work for attaching the container to the casing each time the fanfold paper 16 is set.

It should be noted here that in the fifth embodiment shown in FIG. 9, the insertion of the fanfold paper 16 into the container 17 is not limited to the insertion from above and may be changed to insertion from a side. In this case, a wall is provided for a side surface of the container 17 in order to prevent the inserted fanfold paper 16 from popping out to the outside of the container 17.

What is claimed is:

1. A sheet holding structure connectable in use to a casing of a printer, the sheet holding structure comprising: a container for holding fanfold paper layered by being alternately folded every predetermined length as a recording sheet that is supplied to the casing of the printer, the container having an upper section and a lower section forming an accommodation portion that accommodates the fanfold paper, the lower section having an inner wall surface formed in a concave shape along a lengthwise direction of the fanfold paper so that the fanfold paper curves in an inward direction and exerts an expanding force acting, at least in part, against the self-weight of the fanfold paper and in a direction opposite to the inward direction, an axis of the container in a lengthwise direction thereof dividing the lower section into two opposed side portions that are non-movable relative to one another.

2. A sheet holding structure according to claim 1; wherein the container is fixable to the casing.

3. A printer for an electronic voting apparatus, the printer comprising:

a sheet holding structure according to claim 2;

a print portion arranged in the casing for performing printing on a part of the fanfold paper supplied from the container;

a cutter portion arranged in the casing for cutting off a printed portion of the fanfold paper on which the printing has been performed by the print portion;

a window portion provided to the casing on a downstream side of the print portion in a travel direction of the fanfold paper for allowing visual confirmation of the printed portion from an exterior of the casing; and a discharge opening provided to the casing on a downstream side of the window portion in the travel direction of the fanfold paper for discharging the printed portion cut off by the cutter portion.

4. A sheet holding structure according to claim 1; wherein the container is detachably attachable to the casing.

5. A printer for an electronic voting apparatus, the printer comprising:

a sheet holding structure according to claim 4;

a print portion arranged in the casing for performing printing on a part of the fanfold paper supplied from the container;

a cutter portion arranged in the casing for cutting off a printed portion of the fanfold paper on which the printing has been performed by the print portion;

a window portion provided to the casing on a downstream side of the print portion in a travel direction of the fanfold paper for allowing visual confirmation of the printed portion from an exterior of the casing; and a discharge opening provided to the casing on a downstream side of the window portion in the travel direction of the fanfold paper for discharging the printed portion cut off by the cutter portion.

6. A sheet holding structure according to claim 1; wherein the container is attached to a slide member for slidingly moving the container toward and away from the casing.

7. A printer for an electronic voting apparatus, the printer comprising:

a sheet holding structure according to claim 6;

a print portion arranged in the casing for performing printing on a part of the fanfold paper supplied from the container;

a cutter portion arranged in the casing for cutting off a printed portion of the fanfold paper on which the printing has been performed by the print portion;

a window portion provided to the casing on a downstream side of the print portion in a travel direction of the fanfold paper for allowing visual confirmation of the printed portion from an exterior of the casing; and a discharge opening provided to the casing on a downstream side of the window portion in the travel direction of the fanfold paper for discharging the printed portion cut off by the cutter portion.

8. A printer for an electronic voting apparatus, the printer comprising:

a sheet holding structure according to claim 1;

a print portion arranged in the casing for performing printing on a part of the fanfold paper supplied from the container;

a cutter portion arranged in the casing for cutting off a printed portion of the fanfold paper on which the printing has been performed by the print portion;

a window portion provided to the casing on a downstream side of the print portion in a travel direction of the fanfold paper for allowing visual confirmation of the printed portion from an exterior of the casing; and a discharge opening provided to the casing on a downstream side of the window portion in the travel direction of the fanfold paper for discharging the printed portion cut off by the cutter portion.

9. A sheet holding structure according to claim 1; wherein the container has an opening for drawing out the fanfold paper that is supplied to the casing, the opening of the container being disposed generally directly opposite to a lowermost point of the inner wall surface of the lower section.

10. A sheet holding structure according to claim 9; wherein the central axis extends through the opening of the container.

11. A sheet holding structure according to claim 1; wherein the container has an opening for drawing out the fanfold paper that is supplied to the casing, the upper section having an inner wall surface converging inwardly toward the opening of the container.

12. A sheet holding structure according to claim 11; wherein the central axis extends through the opening of the container.

13. A sheet holding structure according to claim 1; further comprising a cover that is detachably connected to the container to prevent the fanfold paper from falling out of the accommodation portion.

14. A sheet holding structure comprising: a container for holding fanfold paper layered by being alternately folded every predetermined length as a sheet, the container having upper and lower sections that are fixed to each other so as to be non-movable relative one another and that collectively form an accommodation portion that accommodates the fanfold paper, the lower section having an inner wall surface formed in a concave shape along a lengthwise direction of the fanfold paper so that the fanfold paper curves in an inward direction and exerts an expanding force acting, at least in part, against the self-weight of the fanfold paper and in a direction opposite to the inward direction.

15. A sheet holding structure according to claim 14; wherein the upper section is provided with an opening for drawing out the fanfold paper, the opening being disposed generally directly opposite to a lowermost point of the inner wall surface of the lower section.

16. A sheet holding structure according to claim 14; wherein the container is generally symmetrical about a central axis extending in a lengthwise direction thereof.

17. A sheet holding structure according to claim 14; wherein the upper section is provided with an opening for drawing out the fanfold paper, the upper section having an inner wall surface converging inwardly toward the opening of the container.

18. A sheet holding structure according to claim 14; further comprising a cover that is detachably connected to the container to prevent the fanfold paper from falling out of the accommodation portion.

19. A printer comprising:

a sheet holding structure according to claim 14;

a casing connected to the container of the sheet holding structure for receiving the fanfold paper accommodated in the accommodation portion of the container;

a print portion that is arranged in the casing and that performs printing on a portion of the fanfold paper supplied from the container;

a cutter portion that arranged in the casing and that cuts off a printed portion of the fanfold paper on which the printing has been performed by the print portion;

a window portion provided to the casing on a downstream side of the print portion in a travel direction of the fanfold paper for allowing visual confirmation of the printed portion from an exterior of the casing; and a discharge opening provided to the casing on a downstream side of the window portion in the travel direction of the fanfold paper for discharging the printed portion cut off by the cutter portion.

20. A printer according to claim 19; wherein the container is fixed to the casing.

21. A printer according to claim 19; wherein the container is removably connected to the casing.

22. A printer according to claim 19; further comprising a slide member that is connected to the container of the sheet holding structure and that slidingly moves the container toward and away from the casing.

* * * * *